US005230922A

United States Patent [19]

Fleissner

[11] Patent Number: 5,230,922

[45] Date of Patent: Jul. 27, 1993

[54] PROCESS FOR BONDING, IN PARTICULAR, LIGHTWEIGHT FLEECES, AND APPARATUS FOR PERFORMING THE PROCESS

[75] Inventor: Gerold Fleissner, Chur, Switzerland

[73] Assignee: Fleissner Maschinengabrik AG, Rebstein, Switzerland

[21] Appl. No.: 807,239

[22] Filed: Dec. 16, 1991

[51] Int. Cl.[5] ..... B05D 3/12

[52] U.S. Cl. ..... 427/177; 427/296; 427/323; 427/350; 427/375; 427/384; 427/428

[58] Field of Search ..... 427/323, 177, 296, 350, 427/375, 384, 428

[56] References Cited

U.S. PATENT DOCUMENTS 1,286,057 11/1918 Moore ..... 427/323

1,534,676 4/1925 Andrew ..... 427/323 X

*Primary Examiner*—Bernard Pianalto

*Attorney, Agent, or Firm*—Antonelli, Terry, Stout & Kraus

[57] ABSTRACT

In the bonding of lightweight fleeces, there is the problem at relatively high feeding velocities of providing the fleece with the required amount of impregnating agent. Also, it has been found that the individual fibers of a fleece move with respect to one another during the impregnating step, and the fleece tends to disintegrate. In order to impart to the fleece, without great expenditure, a strength required for the bonding procedure, the provision is made to subject the fleece to a preliminary bonding step by wetting with cold water prior to application of the bonding agent, for example in a foam padder. It has been discovered under practical conditions that this minor bonding step is adequate for avoiding disintegration of the loose fiber layer within the nip padder during impregnation.

3 Claims, 1 Drawing Sheet

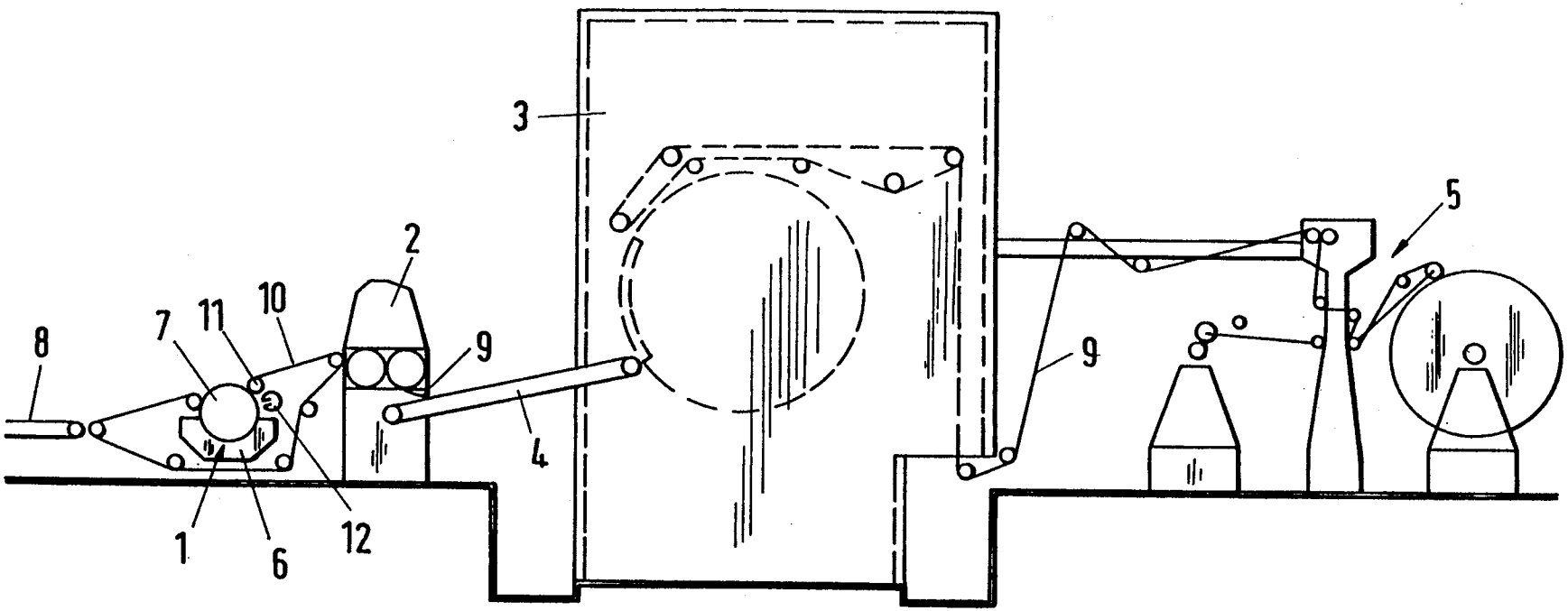
5
9
3
4
9
2
12
10
6
11
1
7
8

PROCESS FOR BONDING, IN PARTICULAR, LIGHTWEIGHT FLEECES, AND APPARATUS FOR PERFORMING THE PROCESS

BACKGROUND OF THE INVENTION

The invention relates, first of all, to a process for the bonding of, in particular, lightweight fleeces by impregnating the fleece with a bonding agent, causing this bonding agent to effect bonding during a heat treatment, and winding the fleece up, and to an apparatus for performing the process.

Carded fleeces are manufactured in all kinds of thicknesses down to 10 g/m$^2$. However, after the carding unit, these fleeces do not as yet exhibit any strength. In case thermoplastic fibers, bicomponent fibers, or the like are mixed into the fleece, the fibrous product is bonded solely by the action of heat, i.e., by heating to the fusing temperature of one of the thermoplastic fibers (see, for example, DE 3,334,787 A1). Other fleeces are bonded by means of a liquid bonding agent. The liquid bonding agent is generally pressed into the fleece in the form of foam in a nip padder. The bonding of the fleece then takes place as a chemical process by the action of heat—namely suitably on a sieve drum under a suction draft.

Especially in connection with lightweight fleeces, there is the problem at higher velocities of introducing the impregnating agent into the fleece. The fibers of the fleece experience mutual shifting in the padder, especially at feeding speeds of 90 m/min and thereabove. In order to avoid this disadvantage, the fleece could be ironed prior to impregnation, but this would cause the fleece to lose volume, which is to be avoided

SUMMARY OF THE INVENTION

The invention is based on the object of developing a process making it possible to mix, in particular, lightweight fleeces even at high velocities readily with the bonding agent required for the chemical bonding step. For attaining the thus-posed object, the invention provides that the fiber fleece is first wetted with cold liquid, e.g. water at about 18°-20° C., and then is impregnated wet-on-wet with the bonding agent, i.e. a water-soluble binder. In this connection, it is advantageous to guide the thin lightweight fleece on both sides through a liquid bath during the wetting step and to dewater, i.e. remove excess liquid from the fleece gently at the end of the wet treatment, which is suitably achieved by subjecting the fleece to a suction step. It has been found under practical conditions that, by means of this simple measure, a strength is produced in the fleece which is adequate for mixing the fleece with the impregnating agent so that even at relatively high velocities of more than 100 m/min also a lightweight fleece can be impregnated with foam and can thus be bonded.

The apparatus for performing the process consists of a wetting device arranged in a continuous installation upstream of the impregnating padder; this wetting device consists advantageously of a sieve drum bath, the sieve drum of which is surrounded by an additional endless screen on the outer circumference. In this arrangement, this additional screen carries the fleece on its topside into the wetting bath and, after wetting, to the adjoining heat treatment unit. It is especially advantageous to associate the screen on its rear side above the liquid level of the saturating bath with a suction removal means so that the fleece held between the sieve drum and the screen can be dewatered upstream of the impregnating padder.

BRIEF DESCRIPTION OF THE DRAWINGS

One embodiment of the apparatus according to the invention is illustrated in the accompanying drawing, wherein the sole figure shows a continuous installation for the bonding of lightweight fleeces in a longitudinal sectional view.

DETAILED DESCRIPTION OF THE INVENTION

The installation, according to the figure, consists of a wetting device denoted by reference numeral 1 in its entirety, an impregnating padder 2, an endless conveyor belt 4 serving as a transport connection and extending from below the padder to an adjoining sieve drum device 3 for drying and heat treating the binder-containing fleece, and a take-up unit denoted by reference numeral 5 in its entirety which follows the sieve drum device 3.

The wetting device 1 illustrated at the beginning of the continuous installation consists of a bath vessel 6 wherein a sieve drum 7 is rotatably supported. It is not necessary for wetting fleeces to subject this sieve drum to a suction draft from the outside toward the inside, but here, too, a standard sieve drum washing machine can be utilized.

The lightweight fleece 9 delivered by the endless conveyor belt 8 of the carding unit, not shown, is first transported on an endless screen belt 10 looped around the sieve drum 7 and furthermore serving as the conveying element for the lightweight fleece to the padder 2. By means of this endless belt 10, the lightweight fleece, guided on both sides, enters between the sieve drum 7 and the belt 10 into the bath 6 and there is merely wetted with cold water. In order to remove any excess liquid absorbed prior to the following impregnating step, a suction extraction device 12 is arranged above the level of the bath vessel 6 and upstream of the first guide roll 11 of the bath; this suction removal device consists of a simple suction bar.

The amount of water applied by the wetting device depends on the composition of the fleece. This also applied to the moisture content after suction at device 12. For a polyester fleece, the moisture content is about 30% and for a cellulose fleece, about 100–110% by weight. The amount of binder applied is also highly dependent on the desired end product. The processing temperature during bonding is between 150° and 170° C. and is also dependent on the type of fiber fleece. The processing temperature also depends on the travel speed of the fleece and the time the fleece is held in the processing chamber. In any case, by the time the fleece leaves the sieve drum drier, the fleece should be dry.

The wetting device is followed—as mentioned above—by the customary continuous production line. Since the constructions of these parts of the installation are generally known, there is no need to provide a detailed explanation.

I claim:

1. A continuous process for bonding a thin lightweight fleece with a bonding agent which comprises guiding the lightweight fleece by contacting the fleece on both sides with perforated support surfaces, wetting the guided fleece with a cold aqueous liquid; subjecting the fleece to suction extraction to remove excess water; then impregnating the wetted fleece with a wet bonding agent; heating the fleece impregnated with the bonding agent to cause the bonding agent to bond the fleece; and winding up the resulting fleece.

2. A process according to claim 1, wherein the bonding agent is caused to bond by heat treating the fleece impregnated with a bonding agent on a sieve drum dryer.

3. A process according to claim 2, wherein prior to heat treatment on the sieve drum dryer, the impregnated fleece is conveyed from a padder for applying the bonding agent to the sieve drum dryer by a conveyor belt to avoid shifting of individual fibers of the fleece prior to the bonding operation.

* * * * *